US010926991B2

(12) United States Patent
Shin et al.

(10) Patent No.: US 10,926,991 B2
(45) Date of Patent: Feb. 23, 2021

(54) WATER DISPENSING APPARATUS AND METHOD FOR CONTROLLING THE SAME

(71) Applicant: LG ELECTRONICS INC., Seoul (KR)

(72) Inventors: Sungyong Shin, Seoul (KR); Euisung Kim, Seoul (KR); Sunyoung Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/559,610

(22) PCT Filed: Sep. 30, 2015

(86) PCT No.: PCT/KR2015/010268
§ 371 (c)(1),
(2) Date: Sep. 19, 2017

(87) PCT Pub. No.: WO2016/148359
PCT Pub. Date: Sep. 22, 2016

(65) Prior Publication Data

US 2018/0057344 A1 Mar. 1, 2018

(30) Foreign Application Priority Data

Mar. 19, 2015 (KR) ..... 10-2015-0037967

(51) Int. Cl.
*B67D 3/00* (2006.01)
*F24H 9/20* (2006.01)
*F24H 1/12* (2006.01)

(52) U.S. Cl.
CPC ..... *B67D 3/0003* (2013.01); *B67D 3/0022* (2013.01); *B67D 3/0041* (2013.01);
(Continued)

(58) Field of Classification Search
CPC ... F24H 1/10; F24H 1/50; F24H 1/142; F24H 1/162; F24H 9/128; F24H 9/20;
(Continued)

(56) References Cited

U.S. PATENT DOCUMENTS 7,036,687 B1 * 5/2006 Lowe ..... A47J 31/401 222/129.1
8,651,331 B2 * 2/2014 Krause ..... B67D 1/0858 222/129

(Continued)

FOREIGN PATENT DOCUMENTS

JP H09224832 9/1997
JP H1079294 3/1998

(Continued)

OTHER PUBLICATIONS

Translation of the specification on JPH 09224832A, Sep. 2, 1997, Shuji Sato, et al.; Matsushita Electric Ind Co. Ltd., A47j 27/21, "Electric Kettle". (Year: 1997).*

(Continued)

*Primary Examiner* — Paul R Durand
*Assistant Examiner* — Andrew P Bainbridge
(74) *Attorney, Agent, or Firm* — Fish & Richardson P.C.

(57) ABSTRACT

A water dispensing apparatus includes a dispensing hole through which hot water is dispensed, a heating passage unit communicating with the dispensing hole; a heating unit for heating water flowing through the heating passage unit, an input unit for inputting a hot water dispensing command for dispensing the hot water through the dispensing hole, a hot water valve for adjusting a flow of the hot water heated in the heating passage unit, and a controller for controlling the heating unit.

18 Claims, 4 Drawing Sheets

(52) U.S. Cl.
CPC ..... *F24H 1/121* (2013.01); *F24H 9/2028* (2013.01); *B67D 2210/00078* (2013.01); *B67D 2210/00102* (2013.01)

(58) Field of Classification Search
CPC .... F24H 9/1818; F24H 9/1809; F24H 9/1827; F24H 9/2014; F24H 9/2028; F24H 1/21; B67D 3/0003; B67D 3/0022; B67D 3/0041; B67D 2210/00078; B67D 2210/00102
USPC ..... 700/231; 222/146.1–146.2, 146.5, 54, 222/282, 287, 504, 540
See application file for complete search history.

(56) References Cited

U.S. PATENT DOCUMENTS

| | | | | |
|---|---|---|---|---|
| 8,967,432 | B2 * | 3/2015 | Bertolini | B67D 7/82 222/146.2 |
| 9,534,814 | B2 * | 1/2017 | Morimoto | F25B 21/00 |
| 2010/0213190 | A1 * | 8/2010 | Bron | F24H 9/0021 219/629 |
| 2011/0079611 | A1 * | 4/2011 | Verhoeven | A47J 31/56 222/129.3 |
| 2012/0293290 | A1 * | 11/2012 | Kido | H01F 27/10 336/60 |
| 2014/0023352 | A1 * | 1/2014 | Jurczyszak | H05B 1/0283 392/466 |
| 2014/0233928 | A1 * | 8/2014 | Moughton | F24H 1/142 392/398 |
| 2014/0270724 | A1 * | 9/2014 | Hall | B67D 7/82 392/341 |
| 2014/0270725 | A1 | 9/2014 | Bertolini et al. | |
| 2015/0110479 | A1 * | 4/2015 | Wu | F24H 9/2028 392/490 |
| 2015/0192346 | A1 * | 7/2015 | Lee | F25D 21/006 62/129 |
| 2016/0287010 | A1 * | 10/2016 | Doglioni Majer | H05B 6/108 |
| 2017/0325294 | A1 * | 11/2017 | Kim | G05D 23/1917 |
| 2018/0057344 | A1 * | 3/2018 | Shin | B67D 3/0041 |

FOREIGN PATENT DOCUMENTS

| | | |
|---|---|---|
| JP | 2007225251 | 9/2007 |
| JP | 2008175423 | 7/2008 |
| KR | 10-2006-0107663 | 10/2006 |
| KR | 10-1371980 | 4/2009 |
| KR | 10-2011-0096868 | 8/2011 |
| KR | 10-2012-00112060 | 10/2012 |
| KR | 10-2013-0006227 | 1/2013 |
| KR | 10-2013-0047783 | 5/2013 |
| KR | 10-2014-0057420 | 5/2014 |
| KR | 10-2015-0008018 | 1/2015 |
| KR | 10-2015-0025785 | 3/2015 |

OTHER PUBLICATIONS

International Search Report in International Application No. PCT/KR2015/010268, dated Jan. 11, 2016, 2 pages (with English translation).

* cited by examiner

WATER DISPENSING APPARATUS AND METHOD FOR CONTROLLING THE SAME

CROSS-REFERENCE TO RELATED APPLICATIONS

This application is a National Stage application under 35 U.S.C. § 371 of International Application No. PCT/KR2015/010268, filed Sep. 30, 2015, which claims the benefit of Korean Application No. 10-2015-0037967, filed on Mar. 19, 2015. The disclosures of the prior applications are incorporated by reference in their entirety.

TECHNICAL FIELD

The present disclosure relates to a water dispensing apparatus and a method for controlling the same.

BACKGROUND ART

Water purifiers among home appliances are apparatuses for filtering introduced water to supply the filtered water into a user.

A water purifier is disclosed in Korean Utility Model Publication No. 2011-0000880 (Publication Date: Jan. 27, 2011) that is Prior Document.

The water purifier includes a space part, a storage container disposed in the space part, and a heating source for heating water contained in the storage container.

However, according to the water purifier disclosed in Prior Document, since the heating source heats water contained in the storage container, a user does not dispense hot water through a connection tube unless the storage container containing water is disposed in the space part.

Also, in case of Prior Document, since the user does not select a desired temperature, user's various tests are not satisfied.

Also, in case of Prior Document, since water stored in the storage container has to be heated in totality, much time is spent to obtain hot water.

Also, in case of Prior Document, hot water varies in temperature according to an amount of water contained in the storage container.

DISCLOSURE OF INVENTION

Technical Problem

Embodiments provides a water dispensing apparatus that is capable of dispensing water having a temperature desired by a user because water is dispensed after being preheated when hot water for a first glass is dispensed and a method for controlling the same.

Embodiments also provides a water dispensing apparatus in which an amount of water to be dispensed increases after the dispensing of water starts to obtain water having a temperature that is close to a target temperature and a method for controlling the same.

Embodiments also provides a water dispensing apparatus in which water is heated while the water flows through a heating passage unit to reduce a standby time that is taken until hot water is dispensed and a method for controlling the same.

Solution to Problem

In one embodiment, a water dispensing apparatus includes: a dispensing part through which hot water is dispensed.

The water dispensing apparatus may further include a heating passage unit communicating with the dispensing part.

The water dispensing apparatus may further include a heating unit configured to heat water flowing through the heating passage unit.

The water dispensing apparatus may further include an input unit configured to input a hot water dispensing command for dispensing the hot water through the dispensing part.

The water dispensing apparatus may further include a hot water valve configured to adjust a flow of the hot water heated in the heating passage unit.

The water dispensing apparatus may further include a controller configured to control the heating unit.

When the hot water dispensing command is inputted through the input unit, the controller may determine whether a preheating process in the heating passage unit is necessary, when it is determined that the preheating process is necessary, the heating unit may operate for a preheating time in a state where the hot water valve is closed, and when it is determined that the preheating process is unnecessary, the hot water valve may be opened, and the heating unit may operate.

The water dispensing apparatus may further include a temperature sensor for detecting a temperature of the water within the heating passage unit.

The controller may determine that the preheating process is necessary when the water temperature detected by the temperature sensor is less than a first reference temperature.

The temperature sensor may detect a surface temperature of the heating passage unit or a temperature of the water discharged from the heating passage unit.

The temperature sensor may include: a surface temperature sensor for detecting a surface temperature of the heating passage unit; and a discharged water temperature sensor for detecting the water discharged from the heating passage unit.

The controller may compare the water temperature detected by the discharged water temperature sensor to the first reference temperature when an elapsing time is less than a reference time after the former hot water is dispensed and compare the water temperature detected by the surface temperature sensor to the first reference temperature when the elapsing time exceeds the reference time after the former hot water is dispensed.

The preheating time may be an elapsing time until the heating unit operates at a reference output to allow the water temperature to reach a target temperature that is set by the input unit.

The reference output may be maintained during the preheating process.

The controller may turn the hot water valve on to discharge hot water through the dispensing part after the preheating process is ended.

The controller may turn the hot water valve on to control a flow rate so that a discharged water flow rate increases until the discharged water flow rate reaches a target flow rate from an initial flow rate.

One of a plurality of target temperatures may be selected through the input unit, and the initial flow rate and the target flow rate may vary according to the selected target temperature.

A time that is taken from the initial flow rate for each target temperature to the target flow rate may be uniformly set regardless of the target temperature selected by the input unit.

The water dispensing apparatus may further include an introduced water temperature sensor for detecting a temperature of water introduced into the heating passage unit.

The controller may determine an output of the heating unit on the basis of the introduced water temperature detected by the introduced water temperature sensor and the target temperature selected by the input unit, and in the flow rate control process, the heating unit may operate at the determined output, and the determined output is maintained.

The water dispensing apparatus may further include a discharged water temperature sensor for detecting a temperature of water discharged from the heating passage unit.

A maximum temperature of the temperature detected by the discharged water temperature sensor may be greater than the target temperature selected by the input unit.

When the discharged water flow rate reaches the target flow rate, the controller may control a flow rate so that the discharged water flow rate is maintained to the target flow rate until the dispensing of the hot water is completed.

The water dispensing apparatus may further include a discharged water temperature sensor for detecting a temperature of water discharged from the heating passage unit.

The controller may control the heating unit so that an output of the heating unit is maintained to the determined output until the discharged water temperature detected by the discharged water temperature sensor reaches a second reference temperature.

The water dispensing apparatus may further include an introduced water temperature sensor for detecting a temperature of water introduced into the heating passage unit.

The controller may determine an output of the heating unit on the basis of the introduced water temperature detected by the introduced water temperature sensor and the target temperature selected by the input unit.

The second reference temperature may be greater than the target temperature selected by the input unit.

When the discharged water temperature reaches the second reference temperature, the controller may control an output of the heating unit so that the discharged water temperature is converged to the target temperature selected by the input unit until the dispensing of the hot water is completed.

When it is determined that the preheating process is unnecessary, the controller may control an output of the heating unit so that the discharged water temperature at the dispensing part is converged to the target temperature selected by the input unit until the dispensing of the hot water is completed.

In another embodiment, a method for controlling a water dispensing apparatus includes: performing a preheating process for preheating water by using the water dispensing apparatus in a state where a hot water valve is turned off when a hot water dispensing command is inputted; turning the hot water valve on to dispense hot water when the preheating process is ended; controlling the hot water valve so that a flow rate of water dispensed from a dispensing part increases up to a target flow rate in the state where the hot water valve is turned on; and controlling the hot water valve so that the discharged water flow rate is maintained to the target flow rate until the dispensing of the hot water is completed.

In further another embodiment, a method for controlling a water dispensing apparatus includes: performing a preheating process in which a heating unit operates for a preheating time at a predetermined output to preheat water when a hot water dispensing command is inputted; performing a primary heating process in which an output of the heating unit is determined on the basis of a temperature of water introduced into a heating passage unit and a target temperature set by an input unit, and the heating unit operates at the determined output when the preheating process is ended; performing a secondary heating process in which the output of the heating unit varies so that a discharged water temperature of the heating passage unit is converged to the target temperature after the primary heating process is ended.

In the preheating process, a flow rate of the water dispensed from a dispensing part may be zero, in the primary heating process, a discharged water flow rate may increase from an initial flow rate to a target flow rate, and, in the secondary heating process, a discharged water flow rate may be uniformly maintained to the target flow rate.

Advantageous Effects of Invention

According to the proposed embodiments, since the heating unit heats water flowing through the heating passage unit, the standby power required for storing hot water may be unnecessary.

Also, since the heating passage unit heats water flowing through the heating passage by using the induction heat, the water in the heating passage may be quickly heated without loss of heat.

Also, since the user sets a target temperature of hot water to obtain the hot water having the set target temperature, the user's tastes may be variously satisfied.

Also, according to the current embodiments, since the preheating is performed if the preheating of water is required, and the preheated water is dispensed, the dispensed water may have a temperature that is equal or close to the target temperature.

Also, in the current embodiment, since the preheating time is determined according to the target temperature and the present water temperature during the preheating, the phenomenon in which the dispensed water has a temperature significantly less or greater than the target temperature may be prevented.

Also, in the current embodiment, when it is determined that whether the preheating is necessary, if the preheating is unnecessary, for example, if the hot water dispensing command is inputted just after the former hot water is dispensed, the water may be directly dispensed without performing the preheating to reduce the hot water dispensing standby time.

Also, in the flow rate control process according to the current embodiment, the dispensed hot water may have a temperature that is equal or close to the target temperature.

Also, in the prediction control according to the current embodiment, sudden variation in temperature of the dispensing water and output of the heating unit may be prevented, and thus, the dispensed water may have a temperature that is equal or close to the target temperature.

MODE FOR THE INVENTION

Figure 1:
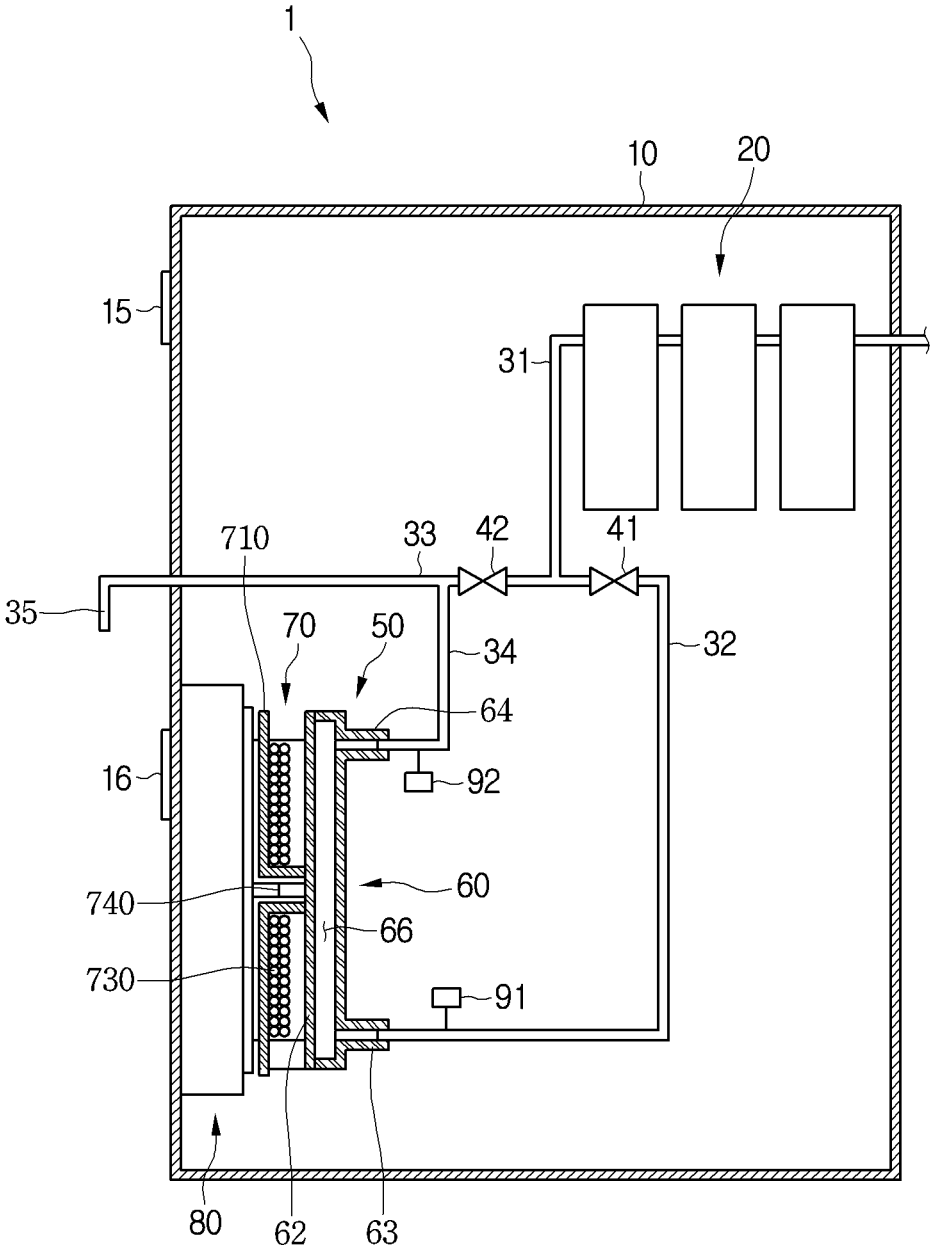
FIG. 1 is a schematic view of a water dispensing apparatus according to an embodiment.

Exemplary embodiments of the present disclosure will be described below in more detail with reference to the accompanying drawings. Note that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

In the description of the elements of the present disclosure, the terms 'first', 'second', 'A', 'B', '(a)', and '(b)' may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

A water dispensing apparatus disclosed in this specification include home appliances having a function for dispensing water such as a refrigerator including a water purifier that is capable of dispensing purified water or having a water dispensing function.

Also, the water purifier may be a direct type water purifier for dispensing water by using a pressure of water supplied into a passage or a water storage tank type water purifier for dispensing water by using a pressure of water stored in a water storage tank.

Figure 2:
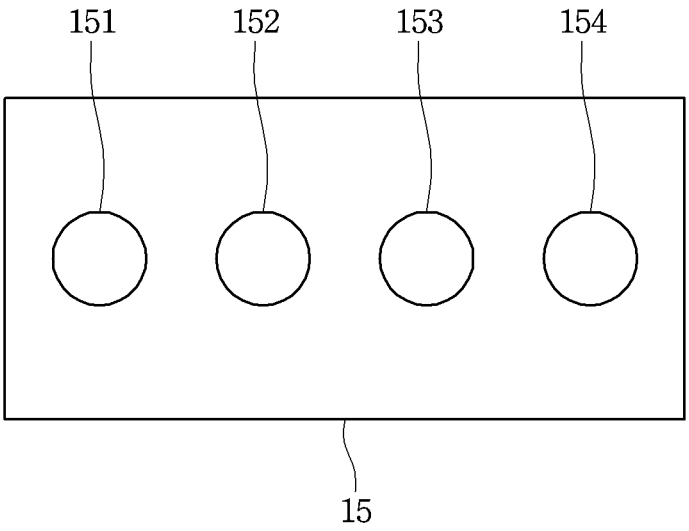
FIG. 2 is a view of an input unit according to an embodiment.
Figure 3:
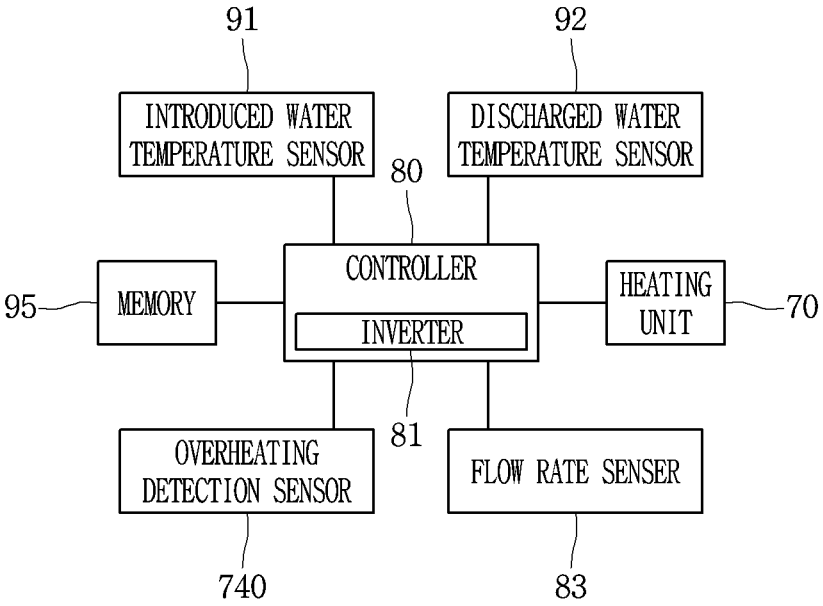
FIG. 3 is a block diagram of the water dispensing apparatus according to an embodiment.

FIG. 1 is a schematic view of a water dispensing apparatus according to an embodiment, FIG. 2 is a view of an input unit according to an embodiment, and FIG. 3 is a block diagram of the water dispensing apparatus according to an embodiment.

FIG. 1 is a schematic view of a water purifier that is provided as an example of a water dispensing apparatus.

Referring to FIGS. 1 to 3, a water dispensing apparatus 1 according to an embodiment may include a housing 10 defining an outer appearance thereof. The housing 10 may include a plurality of panels. That is, the plurality of panels may be coupled to each other to constitute the housing 10. For example, although the housing 10 includes a front panel, two side panels, an upper panel, a rear panel, and a bottom panel, the current embodiment is not limited to the number of panels.

The water dispensing apparatus 1 may further include an input unit 15 for inputting a manipulation command. For example, the input unit 15 may be disposed on the front panel of the housing 10. If the water dispensing apparatus 1 is a refrigerator, the input unit 15 may be disposed on a refrigerator door.

The input unit 15 includes a purified water selection part 151 selected for dispensing purified water through a dispensing part 35, a hot water selection part 152 selected for dispensing hot water through the dispensing part 35, and temperature selection parts 153 and 154 for selecting (setting) a target temperature of hot water to be dispensed.

Although the temperature selection parts 153 and 154 include two buttons in FIG. 2, the current embodiment is not limited to the number of buttons for selecting a temperature and a selection method.

Also, in the current embodiment, a user may select one of at least two target temperatures by using the temperature selection parts 153 and 154. Alternatively, in the current embodiment, the temperature selection parts 153 and 154 may be omitted. In this case, hot water having the preset target temperature may be dispensed.

The water dispensing apparatus 1 may further include a manipulation lever 16 manipulated for dispensing purified water or hot water.

The water dispensing apparatus 1 may further include a filter unit 20 for purifying water supplied from the outside and a purified water passage through which the water passing through the filter unit 20 flows. The filter unit 20 may include at least one filter.

For example, when the filter unit 20 is omitted in the water dispensing apparatus, the purified water passage 31 may be connected to a water tank in which previously purified water is stored.

The purified water passage 31 may be branched into a first passage 32 and a second passage 33.

The second passage 33 may be connected to a dispensing part 35 for dispensing water to the outside of the water dispensing apparatus 1. Water to be heated may flow through the first passage 32.

The water dispensing apparatus 1 may further include an instant hot water device 50. The instant hot water device 50 may include a heating passage unit 60 defining a heating passage 66 in which water supplied from the first passage 32 is heated and a heating unit 70 for heating water flowing through the heating passage 66.

Also, the water dispensing apparatus 1 may further include a controller for controlling the heating unit 70.

The heating passage unit 60 and the heating unit 70 may be accommodated in the housing 10.

If the water dispensing apparatus 1 is a refrigerator, although not limited thereto, the heating unit and the heating passage unit may be disposed in a refrigerator door.

The heating unit 70 may include a frame 710 and a coil part 730 seated on the frame 710. Although not shown, ferrite may be provided on the frame 710.

In the coil part 730, a coil may be wound several times. Here, a plurality of layered coils are stacked. If the coil constituting the coil part 730 is provided with a single layer, an area occupied by the coil part 730 may increase. According to the current embodiment, since the coil is stacked in the plurality of layers, the area occupied by the coil part 730 may be reduced to realize the compact heating unit 70.

The coil part 730 may have a circular ring or oval ring shape on the whole. Alternatively, the coil part 730 may have a polygonal ring shape.

An electric wire connected to the coil part 730 may be connected to the controller 80.

The controller 80 may include an inverter 81. The inverter 81 may control current applied to the coil part 730 to adjust an induction heating amount. That is, an output of the heating unit 70 may be adjusted by the inverter 81.

When the induction heating amount is adjusted as described above, water may be heated at a temperature desired by the user, and thus, hot water having a target temperature that is set by the user may be disposed through the dispensing part 35.

The heating passage unit 60 may include an inflow part 63 into which water is introduced, a first guide 61 having a discharge part 64 through which the heated water (hot water) is discharged, and a second guide 62 defining the heating passage 66 together with the first guide 61.

The second guide 62 may be a magnetic body by which induction heating is enabled. The first guide 62 may be a nonmagnetic body by which the induction heating is not enabled. Alternatively, all of the first and second guides 61 and 62 may be the magnetic body.

When current is applied to the coil part 730, magnetic fields may be generated in the coil part 730. Thus, current may be generated in the second guide 62 by the magnetic fields to heat the second guide 62.

Thus, according to the current embodiment, water within the heating passage 66 defined by the second guide 62 may be heated by the second guide 62. Here, since the whole second guide 62 is heated without loss of heat, the water in the heating passage 66 may be quickly heated.

Also, since a surface of the second guide 62 releases heat, a surrounding temperature of the heating passage unit 60 may not increase. Thus, it may be unnecessary to heat the heating passage unit 60.

Also, since water flowing through the heating passage 66 is momentarily heated, standby power required for storing hot water may be unnecessary.

The discharge part 64 may be connected to the second passage 33 by a third passage 34. Also, a first valve 41 for adjusting a flow of water may be provided in the first passage 32.

A second valve 42 for adjusting a flow of water may be provided between a point of the second passage 33 to which the third passage is connected and a point of the second passage 33 that meets the first passage 32. For another example, the first valve 41 may be provided in the third passage 34.

For another example, the first valve 41 is provided in the third passage 34, and the second valve 42 may be provided between the point of the second passage 33 to which the third passage 34 is connected and the dispensing part 35.

The first valve 41 may continuously or gradationally a flow rate (or flow speed) of water to be heated or heated water.

In the current embodiment, the first valve 41 may be called a hot water valve, and the second valve 42 may be called a purified water valve.

The water dispensing apparatus 1 may further include a flow rate sensor 83 for detecting a flow rate (introduced water flow rate) of water flowing through the heating passage unit 60. The flow rate sensor 83 may be provided in the first passage 32.

For another example, the flow rate sensor 83 may detect a flow rate (discharged water flow rate) of water discharged from the heating passage unit 60 or a flow rate (discharged water flow rate) of water dispensed from the dispensing part 35. In this case, although not limited thereto, the flow rate sensor 83 may be provided in the third passage 34.

In the current embodiment, it is assumed that the introduced water flow rate and the discharged water flow rate are the same. Also, the first valve 41 may be adjusted in opening degree to adjust the introduced water flow rate or the discharged water flow rate.

The water dispensing apparatus 1 may further include an introduced water temperature sensor 91 for detecting a temperature of water to be introduced into the heating passage unit 60 and a discharged water temperature sensor 92 for detecting a temperature of water (hot water) discharged from the heating passage unit 60. In this specification, the temperature detected by the introduced water temperature sensor 91 may be called an introduced water temperature, and the temperature detected by the discharged water temperature sensor 92 may be called a discharged water temperature.

The introduced water temperature sensor 91 may be disposed on the second passage 32 or the inflow part 63.

The discharged water temperature sensor 92 may be disposed on the third passage 34 or the discharge part 33.

The water dispensing apparatus 1 may further include an overheating detection sensor 740 for detecting a temperature of the heating passage unit 60. The overheating detection sensor 740 may contact the heating passage unit 60 or be spaced apart from the heating passage unit 60.

Although not limited thereto, the overheating detection sensor 740 may be disposed within a region in which the coil part 730 is disposed.

The controller 80 may stop an operation of the heating unit 70 when a temperature detected by the overheating detection sensor 740 exceeds a overheating reference temperature to prevent the heating passage unit 60 from being overheated in a state where water does not exist in the heating passage unit 60. That is, the controller 80 may block the current applied to the coil part 730.

Here, the overheating detection sensor 740 may substantially detect a surface temperature of the heating passage unit 60 to indirectly detect a temperature of water within the heating passage 66. Thus, the overheating detection sensor 740 may be called a surface temperature sensor.

The water dispensing apparatus 1 may further include a memory 95 in which information for controlling the heating unit 70 is stored.

Hereinafter, a process in which purified water and hot water are dispensed from the water dispensing apparatus 1 will be described.

First, a purified water dispensing process will be described.

When the purified water selection part 151 is selected, and the manipulation lever is manipulated, the first valve is turned off, and the second valve 42 is turned on. Thus, the water purified by the filter unit 20 may be dispensed through the dispensing part 35 after the purified water flows through the purified water passage 31 and the second passage 33.

Next, a hot water dispensing process will be described.

Figure 4:
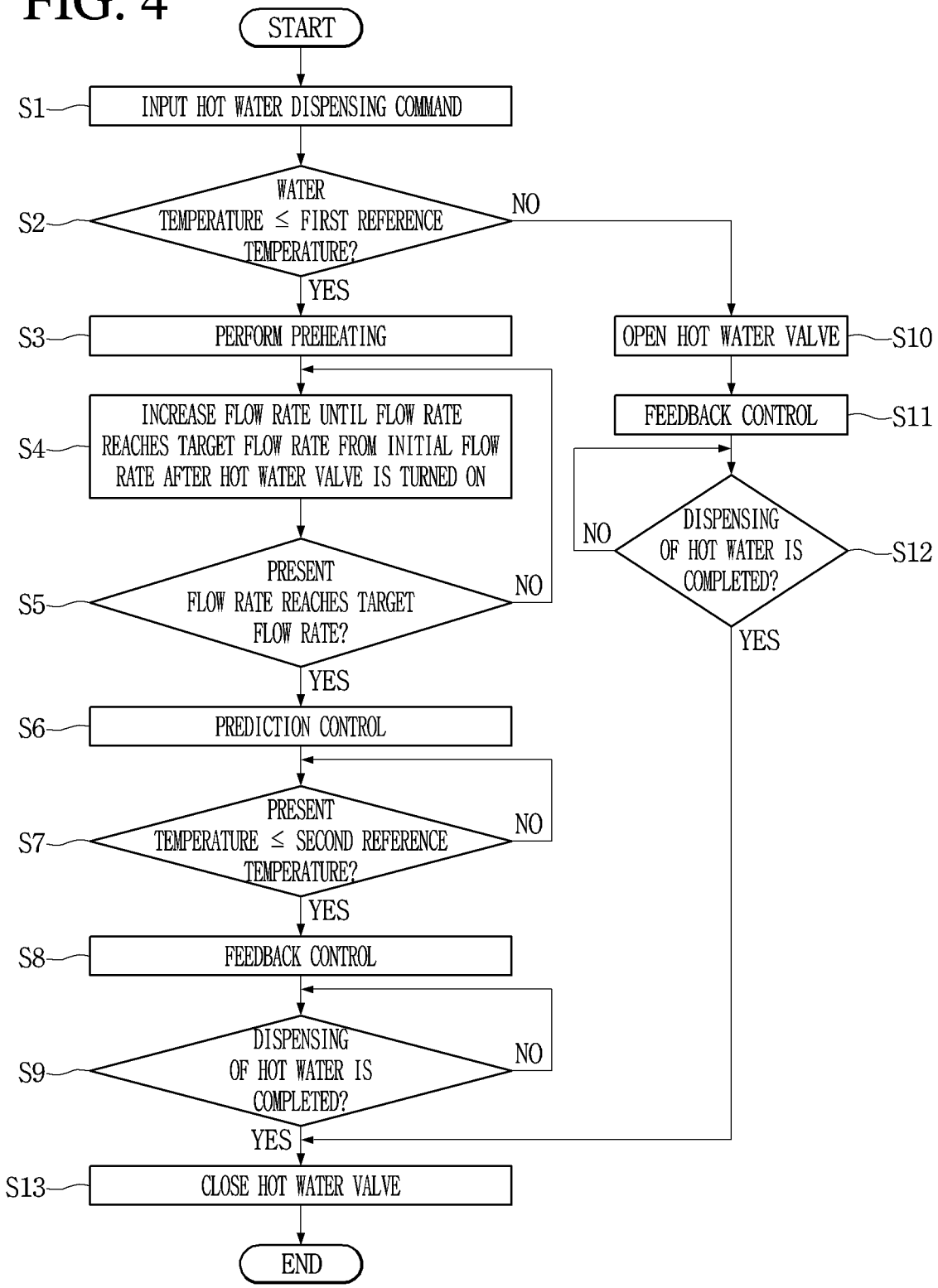
FIG. 4 is a flowchart for explaining a hot water dispensing process according to an embodiment.
Figure 5:
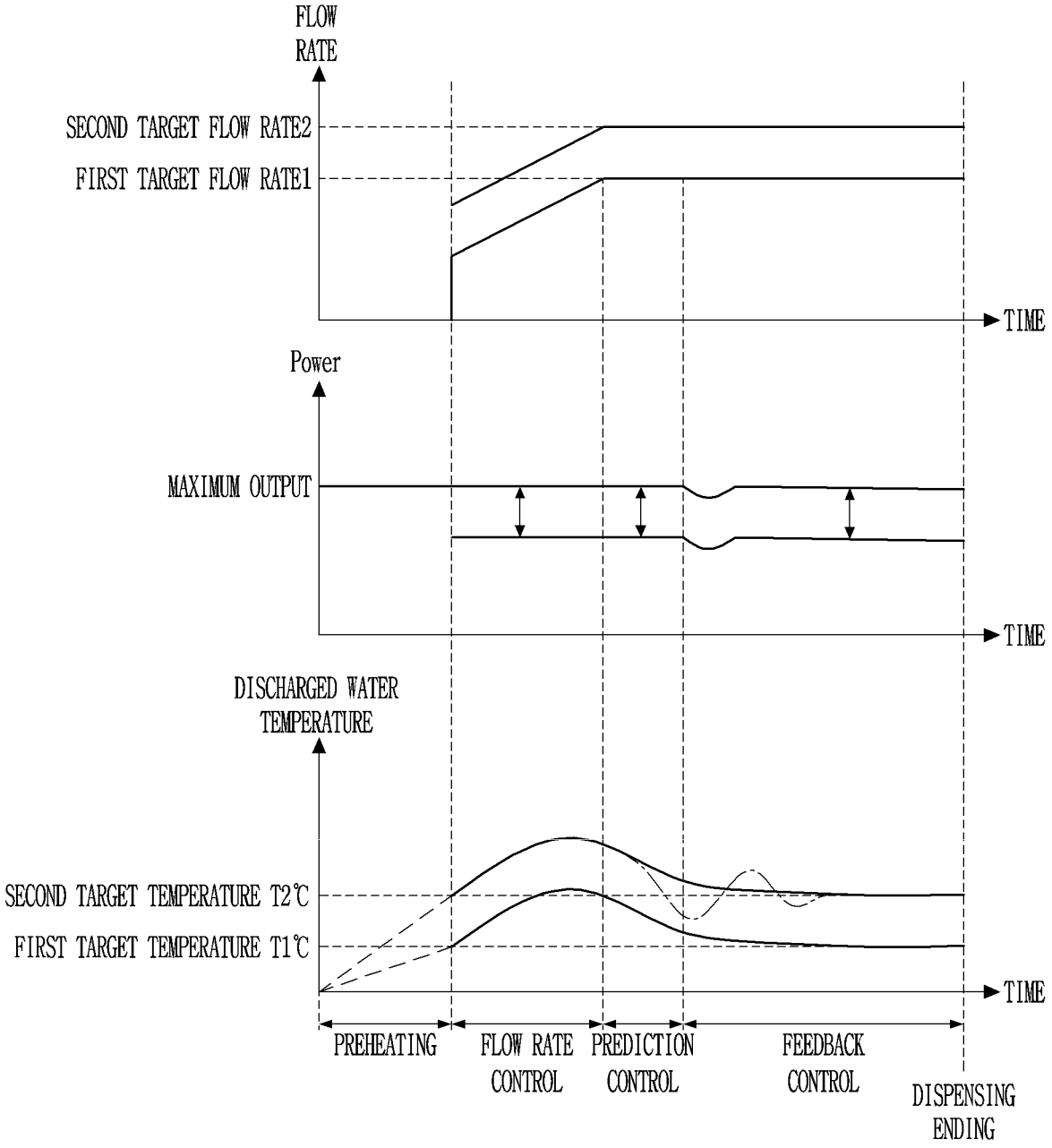
FIG. 5 is a view illustrating a time-varying output of a heating unit and a time-varying temperature and flow rate of water after a hot water dispensing command is inputted.

FIG. 4 is a flowchart for explaining the hot water dispensing process according to an embodiment, and FIG. 5 is a view illustrating a time-varying output of a heating unit and a time-varying temperature and flow rate of water after a hot water dispensing command is inputted.

Referring to FIGS. 1 to 5, a user may input the hot water dispensing command to dispense hot water in operation S1. For example, the hot water dispensing command may be inputted by selecting the hot water selection part 152 and manipulating the manipulation lever 16. However, the current embodiment is not limited to the method for inputting the hot water dispensing command.

Here, before the hot water dispensing command is inputted, a target temperature of hot water to be dispensed may be inputted or selected through the input unit 15.

Hereinafter, a case in which water exists in the heating passage 66 will be described.

When the hot water dispensing command is inputted, the controller 80 may determine whether the detected water temperature is less than a first reference temperature in operation S2. In the current embodiment, the operation S2 may be called a process of determining whether a preheating process is necessary.

In the current embodiment, the first reference temperature is less than the target temperature.

In the current embodiment, when an elapsing time after the former hot water is discharged is less than a reference time, a temperature detected by the discharged water temperature sensor 92 is selected as the detected water temperature. When the elapsing time exceeds the reference time, a temperature detected by the overheating detection sensor 740 may be selected as the detected water temperature.

This is done because, when the elapsing time after the former hot water is discharged is less than the reference time, an actual temperature of the water within the heating passage 66 is similar to that detected by the discharged water temperature sensor 92, and when the elapsing time exceeds the reference time, an actual temperature of the water within the heating passage 66 is similar to that detected by the overheating detection sensor 740.

When a temperature that is maximally similar to the actual temperature of the water within the heating passage 60 is selected, the determined preheating time may increase in accuracy.

Alternatively, the controller 80 may compare the temperature detected by the discharged water temperature sensor 92 or the overheating detection sensor 740 to the first reference temperature regardless of the elapsing time after the former hot water discharge.

According to the result determined in the operation S2, when the detected water temperature is less than the first reference temperature, i.e., when the preheating process is necessary, the preheating process after water is dispensed may be performed in operation S3.

In this specification, the first reference temperature may be less than the target temperature that is set by the user and also may vary according to the target temperatures. However, the first reference temperature for each target temperature may be previously stored in the memory 95.

In the current embodiment, the first valve 41 is maintained in the closed state during the preheating process. Thus, even though the hot water dispensing command is inputted, water may not be dispensed through the dispensing part 35 during the preheating process.

The controller 80 determines a preheating time until the detected water temperature reaches the set target temperature. Here, the controller 80 may determine a preheating time until the detected water temperature reaches the set target temperature when the heating unit 70 operates at a predetermined output. Although not limited thereto, the predetermined output may be a maximum output.

As described above, since the preheating time is determined as a time taken until the detected water temperature reaches the set target temperature, the more the detected water temperature is similar to the actual water temperature, the more the preheating time may increase in accuracy.

Also, the controller 80 operates the heating unit 70 at the predetermined output during the determined preheating time. In the current embodiment, although not shown, the controller 80 may include a timer for checking the elapsing time.

Referring to FIG. 5, for example, the discharged water flow rate may be zero during the preheating process, and the heating unit 70 may be uniformly maintained at the maximum output during the preheating time.

Thus, the water within the heating passage unit 60 may be heated in a state where the water does not flow to increase in temperature during the preheating process. When the preheating is completed, a temperature of the water within the heating passage 66 may increase up to the target temperature.

In operation S4, when the preheating is completed, the controller 80 turns the first valve 41 (the hot water valve) on, and a flow rate increases until the discharge flow rate reaches a target flow rate from an initial flow rate. In the current embodiment, the operation S4 may be called a flow rate control process.

That is, when the first valve 41 is turned on after the preheating is completed, the discharged water flow rate at the turn-on time point may be the initial flow rate that is less than the target flow rate.

Also, the controller 80 may increase the discharged water flow rate according to a predetermined increasing flow rate inclination until the discharged water flow rate reaches the target flow rate.

For example, to increase the discharged water flow rate, an opening degree of the first valve 41 may increase in stage. Also, when the discharged water flow rate reaches the target flow rate, the controller 80 may maintain the state (the opening degree) of the first valve 41 to the present state (the present opening degree) so that the discharged water flow rate is maintained to the target flow rate.

In the current embodiment, the initial flow rate may vary according to the target temperature that is set by the user. Also, the initial flow rate corresponding to the target temperature may be previously stored in the memory 95.

Also, the target flow rate may vary according to the target temperature that is set by the user. Also, the target flow rate corresponding to the target temperature may be previously stored in the memory 95.

Also, the flow rate inclination may have a constant value regardless of the target temperature.

Thus, when a first target temperature is set, a first initial flow rate and a first target flow rate may be determined. When a second target temperature is set, a second initial flow rate and a second target flow rate may be determined.

Here, a time that is taken to reach the first target flow rate from the first initial flow rate may be equal to that taken to reach the second target flow rate from the second initial flow rate.

Although not limited thereto, when the target temperature is high, the initial flow rate and the target flow rate may be set to have low values when compared to a case in which the target temperature is low.

Also, in the flow rate control process, the controller 80 may determine an output of the heating unit 70 on the basis of the introduced water temperature detected by the introduced water temperature sensor 91 and the set target temperature to control the heating unit 70 so that the heating unit 70 operates at the determined output.

In the current embodiment, the output of the heating unit 70 may vary according to the introduced water temperature and the target temperature. When the introduced water temperature and the target temperature are decided once, the output of the heating unit 70 may be uniform in the flow rate control process. In general, the determined output may be less than the maximum output.

Referring to FIG. 5, in the flow rate control process, the discharged water flow rate increases from the initial flow rate up to the target flow rate. When the flow rate control process starts, the first valve 41 may be turned on to dispense hot water through the dispensing part 35.

In the flow rate control process, the discharged water temperature increases up to a temperature (a maximum heating temperature) that is greater than the target temperature. Also, in the flow rate control process, the determined output of the heating unit 70 may be uniformly maintained.

In operation S6, the controller determines whether the present flow rate reaches the target flow rate to end the flow rate control process and perform a prediction control when the present flow rate reaches the target flow rate.

In the prediction control process, the controller 80 may determine an output of the heating unit 70 on the basis of the introduced water temperature detected by the introduced water temperature sensor 91 and the set target temperature to control the heating unit 70 so that the heating unit 70 operates at the determined output. In general, the determined output may be less than the maximum output.

In the prediction control process, the output of the heating unit 70 may vary according to the introduced water temperature and the target temperature, like the flow rate control process. When the introduced water temperature and the target temperature are decided once, the output of the heating unit 70 may be uniform in the prediction control process.

Also, in the prediction control process, the discharged water flow rate may be uniform to the target flow rate.

Referring to FIG. 5, in the prediction control process, the discharged water temperature decreases.

In operation S7, the controller 80 determines whether the discharged water temperature reaches a temperature that is less than the second reference temperature. Also, in operation S8, when the discharged water temperature is less than the second reference temperature, the controller 80 ends the prediction control process and performs a feedback control. Here, the second reference temperature is greater than the target temperature and less than the maximum heating temperature.

In the feedback control process, the controller 80 may control the output of the heating unit 70 so that the detected discharged water temperature is maintained to the target temperature.

According to the feedback control process, the discharged water temperature may be converged to the target temperature. Here, the "convergence" may represent a case in which the discharged water temperature is maintained to a temperature that is equal to the target temperature, and also, the discharged water temperature is maintained within a range corresponding to a predetermined difference between the target temperature and the discharged water temperature.

Thus, the controller 80 may control the heating unit 70 so that the output of the heating unit 70 is uniformly maintained until the discharged water temperature reaches the second reference temperature. Then, when the discharged water temperature reaches the second reference temperature, the controller 80 changes the output of the heating unit 70.

In the feedback control process, a proportional integral control or hysteresis control which controls an output on the basis of the discharged water temperature may be performed. Since the proportional integral control or hysteresis control is realized through the well-known technology, its detailed description will be omitted.

In operation S9, the controller 80 may determine whether the dispensing of the hot water is completed while the feedback control is performed.

In the current embodiment, the case in which the dispensing of the hot water is completed may be a case in which a hot water dispensing ending command is inputted or a case in which an accumulation amount of dispensed water reaches a reference amount. The hot water dispensing ending command may be a case in which the manipulation lever 16 is pushed while the hot water is dispensed. In the current embodiment, a method for inputting the hot water dispensing ending command is not limited.

According to the result determined in the operation S9, when the hot water dispensing is completed, the controller 80 closes the first valve 41 (the hot water valve) to end the dispensing of the hot water.

According to the result determined in the operation S2, in operation S10, when the detected water temperature exceeds the first reference temperature, i.e., when the preheating process is unnecessary, the controller 89 may not perform the preheating process, but may open the first valve 41 (the hot water valve) just. The heating unit 70 operates. Here, when the first valve 41 is opened, the discharged water flow rate may be the target flow rate.

Also, in operation S11, the controller 80 may perform the feedback control on the basis of the discharged water temperature. In operation S12, the controller 80 may determine whether the dispensing of the hot water is completed while the feedback control is performed. Then, when the dispensing of the hot water is completed, the controller 80 may close the first valve 41 (the hot water valve) to end the dispensing of the hot water.

According to the proposed embodiment, following effects may be expected.

First, in the current embodiment, whether the preheating process is necessary is determined. If the preheating process is necessary, the preheating process is performed.

If the hot water dispensing command is inputted to dispense water just without determining that the preheating process is unnecessary, when water that is initially dispensed has a low temperature (for example, the water within the heating passage is not heated), since the water dispensed when the dispensing of the hot water is completed has a temperature less than the target temperature that is set by the user, user's inconvenience may occur.

However, according to the current embodiments, since the preheating process is performed if the preheating of water is required, and the preheated water is dispensed, the water dispensed when the dispensing of the hot water is completed may have a temperature that is equal to or close to the target temperature.

Also, in the current embodiment, since the preheating time is determined according to the target temperature and the present water temperature during the preheating, the phenomenon in which the dispensed water has a temperature significantly less or greater than the target temperature may be prevented.

That is, when the preheating time is regular regardless of the target temperature and the present water temperature, the water after the preheating process is performed may have a temperature that is significantly higher or lower than the target temperature according to the target temperature or the present water temperature. However, according to the current embodiment, since the preheating time is determined based on the target temperature and the present water temperature, the dispensed water may have a temperature that is equal or similar to the target temperature.

Also, in the current embodiment, when it is determined that whether the preheating process is necessary, if the preheating process is unnecessary, for example, if the hot water dispensing command is inputted just after the former hot water is dispensed, the water may be directly dispensed without performing the preheating to reduce the hot water dispensing standby time.

In summary, according to the current embodiment, when the hot water is initially dispensed, the temperature of the dispensed hot water may be equal or close to the target temperature through the preheating. Also, when the hot water is dispensed several times, the hot water dispensing time may be minimized.

Also, in the flow rate control process according to the current embodiment, the dispensed hot water may have a temperature that is equal to or close to the target temperature when the dispensing of the hot water is completed.

In the preheating process, water within the heating passage 66 may be heated to the target temperature, or water between the dispensing part 35 and the heating passage unit 60, e.g., water existing within the second passage 33 and the third passage 34 may have a temperature less than the target temperature. Also, after the preheating process is ended, while water flows from the heating passage 66 to the dispensing part 35, the water may decrease in temperature by air surrounding the passage.

Thus, when the flow rate control is not performed, water having a temperature less than the target temperature may be dispensed through the dispensing part 35 (temperature decreasing factor). Thus, the hot water may decrease in temperature while the hot water is dispensed (temperature decreasing factor) to cause a phenomenon in which the dispensed hot water has a temperature less than the target temperature when the dispensing of the hot water is completed.

However, according to the current embodiment, since a flow rate increases until the initial flow rate is greater than the target flow rate, and the discharged water flow rate reaches the target flow rate by the flow rate control, the discharged water temperature may be heated up to a temperature (maximum heating temperature) greater than the target temperature while the water is initially discharged, and the discharged water flow rate increases.

Thus, according to the current embodiment, even though water having a temperature less than the target temperature is dispensed, and hot water decreases in temperature while being dispensed, a value corresponding to a difference between the target temperature and the maximum heating temperature may compensate a temperature decreasing value due to the temperature decreasing factor to allow the temperature of the dispensed hot water to be equal or close to the target temperature when the dispensing of the hot water is completed.

Also, in the prediction control according to the current embodiment, sudden variation in temperature and output of the heating unit may be prevented, and thus, the dispensed water may have a temperature that is equal or close to the target temperature.

If the feedback control is performed just without performing the prediction control after the flow rate control is ended, a variation in discharged water temperature and a variation in output of the heating unit may increase as illustrated as a dashed dotted line of FIG. 5.

That is, in the feedback control process, the output of the heating unit may be controlled so that the discharged water temperature reaches the target temperature. When the flow rate control process is ended, the discharged water temperature may be greater than the target temperature. Here, the controller may determine that the discharged water temperature is high to reduce the output of the heating unit. Then, when the discharged water temperature decreases to a temperature that is less than the target temperature, the output of the heating unit may increase again. Here, the above-described processes may be performed several times. Thus, the discharged water temperature may decrease until the discharged water temperature converged to the target temperature.

However, according to the current embodiment, when the prediction control is performed after the flow rate control process is ended, since the output of the heating unit is maintained until the discharged water temperature reaches the second reference temperature, the variation in discharged water temperature and the variation in output of the heating unit may be minimized.

In the current embodiment, when the user pushes the manipulation lever 16 again while the preheating process is performed (i.e., a hot water dispensing cancel command is inputted), the controller 80 may end the preheating process after the preheating process is performed for a predetermined preheating time. This is done for quickly dispensing hot water when the user pushes the manipulation lever 16 again (i.e., the hot water dispensing command is inputted again).

Also, when the preheating process is ended after the manipulation lever 16 is pushed again, if an elapsing time until the manipulation lever 16 is pushed again after the preheating process is ended (i.e., an elapsing time until the hot water dispensing command is imputed again) exceeds the reference time, the controller 80 may compare the water temperature detected by the overheating detection sensor 740 to the first reference temperature to determine whether the preheating is necessary.

Also, when the preheating process is ended after the manipulation lever 16 is pushed again, if the elapsing time until the manipulation lever 16 is pushed again after the preheating process is ended (i.e., the elapsing time until the hot water dispensing command is imputed again) is within the reference time, the controller 80 may not perform the preheating process. In this case, the controller 80 may perform the process after the operation S4.

In this specification, in aspect of the heating of the water by using the heating unit, when the flow rate control process and the prediction control process are determined once by the output of the heating unit, the determined output may be maintained. Thus, this process may be called a primary heating process. Also, the output of the heating unit may vary by the feedback control according to the discharged water temperature. Thus, this process may be called a secondary heating process.

All components may be coupled to one another to form a single body or to operate as a single body, but the present disclosure is not limited thereto. That is, one or more components are selectively coupled and operated within the scope of the present disclosure. The terms "comprising," "including," and "having," as used in the claims and specification herein, shall be considered as indicating an open group that may include other elements not specified.

Unless terms used in the present disclosure are defined differently, the terms may be construed as meaning known to those skilled in the art. Terms such as terms that are generally used and have been in dictionaries should be construed as having meanings matched with contextual meanings in the art. In this description, unless defined clearly, terms are not ideally, excessively construed as formal meanings.

The above-disclosed subject matter is to be considered illustrative, and not restrictive, and the appended claims are intended to cover all such modifications, enhancements, and other embodiments, which fall within the true spirit and scope of the present disclosure. Thus, to the maximum extent allowed by law, the scope of the present invention is to be determined by the broadest permissible interpretation of the following claims and their equivalents, and shall not be restricted or limited by the foregoing detailed description.

The invention claimed is:

1. A water dispensing apparatus comprising:

a dispensing part through which hot water is dispensed;

a heating passage unit configured to communicate with the dispensing part, including a magnetic body by which induction heating is enabled;

a heating unit configured to heat water flowing through the heating passage unit and including a coil part that is configured to heat the heating passage unit by induction heating;

an input unit configured to input a hot water dispensing command for dispensing the hot water through the dispensing part;

a hot water valve configured to adjust a flow of the hot water heated in the heating passage unit; and a controller configured to control the heating unit and including an inverter to control current applied to the coil part to adjust an induction heating amount, wherein, when the hot water dispensing command is inputted through the input unit, the controller determines whether a preheating process in the heating passage unit is necessary, when the controller determines that the preheating process is necessary, the controller operates the heating unit for a preheating time in a state where the hot water valve is closed, and when the controller determines that the preheating process is unnecessary, the controller operates the hot water valve to be opened and operates the heating unit, wherein the controller is configured to turn the hot water valve on to discharge hot water through the dispensing part after the preheating process is ended, and configured to control a flow rate so that a discharged water flow rate increases until the discharged water flow rate reaches a target flow rate from an initial flow rate regardless of temperature of discharged hot water, and when the discharged water flow rate reaches the target flow rate, the controller is configured to control a flow rate so that the discharged water flow rate is maintained to the target flow rate until the dispensing of the hot water is completed.

2. The water dispensing apparatus of claim 1, further comprising a temperature sensor configured to detect a temperature of the water within the heating passage unit, wherein the controller is configured to determine that the preheating process is necessary when the water temperature detected by the temperature sensor is less than a first reference temperature.

3. The water dispensing apparatus of claim 2, wherein the temperature sensor is configured to detect a surface temperature of the heating passage unit.

4. The water dispensing apparatus of claim 2, wherein the temperature sensor is configured to detect a temperature of the water discharged from the heating passage unit.

5. The water dispensing apparatus of claim 2, wherein the temperature sensor comprises:

a surface temperature sensor configured to detect a surface temperature of the heating passage unit; and a discharged water temperature sensor configured to detect the water discharged from the heating passage unit, wherein the controller is configured to compare the temperature detected by the discharged water temperature sensor to the first reference temperature when an elapsing time is less than a reference time after the former hot water is dispensed and to compare the temperature detected by the surface temperature sensor to the first reference temperature when the elapsing time exceeds the reference time after the former hot water is dispensed.

6. The water dispensing apparatus of claim 2, wherein the preheating time is an elapsing time until the heating unit operates at a reference output to allow the water temperature to reach a target temperature that is set by the input unit.

7. The water dispensing apparatus of claim 6, wherein the reference output is maintained during the preheating process.

8. The water dispensing apparatus of claim 1, wherein one of target temperatures is selected through the input unit, and the initial flow rate and the target flow rate vary according to a selected target temperature.

9. The water dispensing apparatus of claim 8, wherein a time that is taken from the initial flow rate for each target temperature to the target flow rate is uniformly set regardless of the target temperature selected by the input unit.

10. The water dispensing apparatus of claim 1, further comprising an introduced water temperature sensor configured to detect a temperature of water introduced into the heating passage unit, wherein the controller is configured to determine an output of the heating unit on a basis of an introduced water temperature detected by the introduced water temperature sensor and the target temperature selected by the input unit, and in the flow rate control process, the heating unit operates at a determined output, and the determined output is maintained.

11. The water dispensing apparatus of claim 1, further comprising a discharged water temperature sensor configured to detect a temperature of water discharged from the heating passage unit, wherein a maximum temperature of the temperature detected by the discharged water temperature sensor is greater than the target temperature selected by the input unit.

12. The water dispensing apparatus of claim 1, further comprising a discharged water temperature sensor configured to detect a temperature of water discharged from the heating passage unit, wherein the controller is configured to control the heating unit so that an output of the heating unit is maintained to a determined output until the discharged water temperature detected by the discharged water temperature sensor reaches a second reference temperature.

13. The water dispensing apparatus of claim 12, further comprising an introduced water temperature sensor configured to detect a temperature of water introduced into the heating passage unit, wherein the controller is configured to determine an output of the heating unit on a basis of an introduced water temperature detected by the introduced water temperature sensor and the target temperature selected by the input unit.

14. The water dispensing apparatus of claim 12, wherein the second reference temperature is greater than the target temperature selected by the input unit.

15. The water dispensing apparatus of claim 12, wherein, when the discharged water temperature reaches the second reference temperature, the controller is configured to control an output of the heating unit so that the discharged water temperature is converged to the target temperature selected by the input unit until the dispensing of the hot water is completed.

16. The water dispensing apparatus of claim 1, wherein when the controller determines that the preheating process is unnecessary, the controller is configured to control an output of the heating unit so that the discharged water temperature at the dispensing part is converged to the target temperature selected by the input unit until the dispensing of the hot water is completed.

17. The water dispensing apparatus of claim 1, wherein the coil part comprises a plurality of layered coils that are stacked.

18. The water dispensing apparatus of claim 1, wherein the coil part is configured to face the second guide.

* * * * *